US008887542B2

(12) United States Patent
Bogdanov et al.

(10) Patent No.: US 8,887,542 B2
(45) Date of Patent: Nov. 18, 2014

(54) MOTOR DRIVE MECHANISM FOR AN ELECTRONIC DEADBOLT LOCK

(75) Inventors: Victor Bogdanov, Manchester, CT (US); Alfred Simon Levesque, Newington, CT (US); John Walsh, Wallingford, CT (US)

(73) Assignee: Schlage Lock Company, Carmel, IN (US)

( * ) Notice: Subject to any disclaimer, the term of this patent is extended or adjusted under 35 U.S.C. 154(b) by 1042 days.

(21) Appl. No.: 12/740,841

(22) PCT Filed: Oct. 31, 2008

(86) PCT No.: PCT/US2008/081964

§ 371 (c)(1), (2), (4) Date: Jul. 30, 2010

(87) PCT Pub. No.: WO2009/059112

PCT Pub. Date: May 7, 2009

(65) Prior Publication Data

US 2010/0294008 A1 Nov. 25, 2010

Related U.S. Application Data

(60) Provisional application No. 61/001,146, filed on Oct. 31, 2007.

(51) Int. Cl.

| | |
|---|---|
| ***E05B 47/00*** | (2006.01) |
| ***E05B 63/00*** | (2006.01) |
| ***E05B 47/06*** | (2006.01) |

(52) U.S. Cl.

CPC ..... *E05B 63/0017* (2013.01); *E05B 2047/0023* (2013.01); *E05B 47/0012* (2013.01); *E05B 2047/0086* (2013.01); *E05B 2047/0016* (2013.01); *E05B 2047/0031* (2013.01); *E05B 2047/0026* (2013.01); *E05B 47/0692* (2013.01)

USPC ..... 70/277; 70/280; 464/57

(58) Field of Classification Search

USPC ..... 70/275, 277, 278.7, 280; 74/606 R; 464/57–60

See application file for complete search history.

(56) References Cited

U.S. PATENT DOCUMENTS

| | | | | |
|---|---|---|---|---|
| 1,472,782 | A | 11/1923 | Barber | |
| RE25,543 | E | 3/1964 | Ruegg et al. | |
| 4,615,371 | A | 10/1986 | Clauss | |
| 5,083,122 | A * | 1/1992 | Clark | 70/278.1 |
| 5,427,468 | A | 6/1995 | Muellenberg | |
| 5,628,216 | A * | 5/1997 | Qureshi et al. | 70/278.7 |
| 7,918,114 | B2 * | 4/2011 | Walsh, III | 70/283 |
| 8,302,438 | B2 * | 11/2012 | Lui | 70/277 |
| 2006/0102459 | A1 | 5/2006 | Ottolini et al. | |
| 2006/0111613 | A1 | 5/2006 | Boutillette et al. | |
| 2010/0122561 | A1 * | 5/2010 | Lui | 70/277 |
| 2012/0198897 | A1 * | 8/2012 | Lui | 70/280 |

FOREIGN PATENT DOCUMENTS

| | | |
|---|---|---|
| KR | 20-0192541 | 8/2000 |
| KR | 10-2003-0066506 | 8/2003 |
| WO | 2007/120794 | 10/2007 |

* cited by examiner

*Primary Examiner* — Christopher Boswell

(74) *Attorney, Agent, or Firm* — Michael Best & Friedrich LLP

(57) ABSTRACT

An apparatus including a motor that has a rotatable output shaft extending outward from the motor and defining a rotational axis. The apparatus also includes a coupler that is coupled to the output shaft for rotation therewith, and a coil spring that is coupled to the coupler without external attachment means such that rotation of the coupler is transferred to the coil spring.

27 Claims, 6 Drawing Sheets

MOTOR DRIVE MECHANISM FOR AN ELECTRONIC DEADBOLT LOCK

RELATED APPLICATIONS

This patent application claims priority to U.S. Patent Application Ser. No. 61/001,146 filed Oct. 31, 2007, the entire contents of which are hereby incorporated by reference.

BACKGROUND

The invention relates to a lock system for a door. More particularly, the invention relates to a motor drive mechanism that is used with an entry control device to control access through the door.

SUMMARY

The invention provides an apparatus that includes a motor having a rotatable output shaft extending outward from the motor and defining a rotational axis. The apparatus also includes a coupler and a coil spring. The coupler is coupled to the output shaft for rotation therewith. The coil spring is coupled to the coupler without external attachment means such that rotation of the coupler is transferred to the coil spring.

In another construction, the invention provides an apparatus that includes a motor having a rotatable output shaft extending outward from the motor and defining a rotational axis. The apparatus also includes a coupler and a coil spring. The coupler is coupled to the output shaft for rotation therewith, and includes a spring receiving portion that has a recess extending axially along the coupler. The coil spring is coupled to the coupler over the spring receiving portion and extends into the recess such that rotation of the coil spring relative to the coupler is limited during attachment of the coil spring to the coupler.

In yet another construction, the invention provides an electronic lock assembly that includes a retractable and extendable deadbolt that is movable between a locked position and an unlocked position. The electronic lock assembly also includes a housing, a controller, and a keypad. The housing has a base plate that is attachable to a door, an escutcheon, and a retaining wall that is positioned between the base plate and the escutcheon and movably mounted to the base plate. The controller is coupled to the base plate for controlling movement of the deadbolt between the locked position and the unlocked position. The keypad is coupled to the escutcheon and is in communication with the controller to deliver one or more inputs to the controller. The electronic lock assembly further includes a motor drive mechanism that has a motor, a coupler, and a coil spring. The motor is in communication with the controller for controlling operation of the motor drive mechanism, and has a rotatable output shaft that extends outward from the motor and that defines a rotational axis. The coupler is coupled to the output shaft for rotation therewith. The coil spring is attached to the coupler without external attachment means, and is in communication with the output shaft via the coupler such that rotational movement of the output shaft is transferred to the coil spring. The coil spring is further in communication with the retaining wall such that the rotational movement of the coil spring is translated into substantially linear movement of the retaining wall.

Aspects of the invention will become apparent by consideration of the detailed description and accompanying drawings.

DETAILED DESCRIPTION

Before any constructions of the invention are explained in detail, it is to be understood that the invention is not limited in its application to the details of construction and the arrangement of components set forth in the following description or illustrated in the following drawings. The invention is capable of other constructions and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

FIGS. 1A, 1B, 1C, 2, and 3 illustrate a lock assembly 10 that is, except as described below, substantially identical to the lock assembly described by PCT Application Serial No. PCT/US2007/009075, the entire contents of which are incorporated herein by reference.

Figures 1A, 1B, 1C:
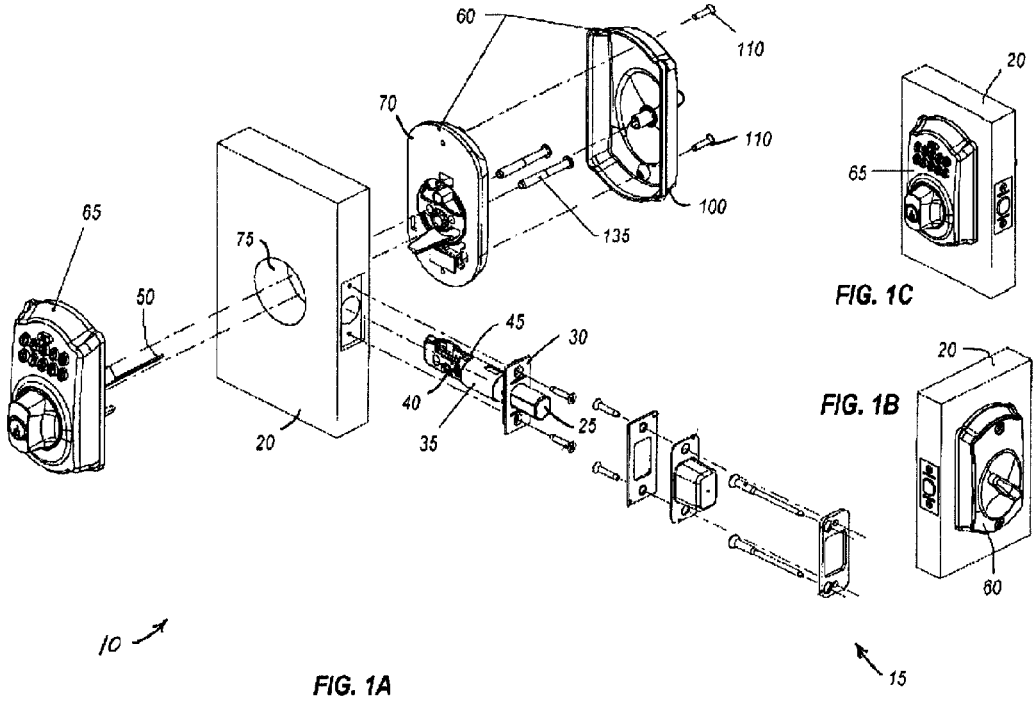
FIG. 1A is an exploded perspective view of a deadbolt lock assembly embodying the invention.
FIG. 1B is a perspective view of an inside escutcheon assembly of the lock assembly of FIG. 1 mounted on a door.
FIG. 1C is a perspective view of an outside escutcheon assembly of the lock assembly of FIG. 1 mounted on the door.
Figure 2:
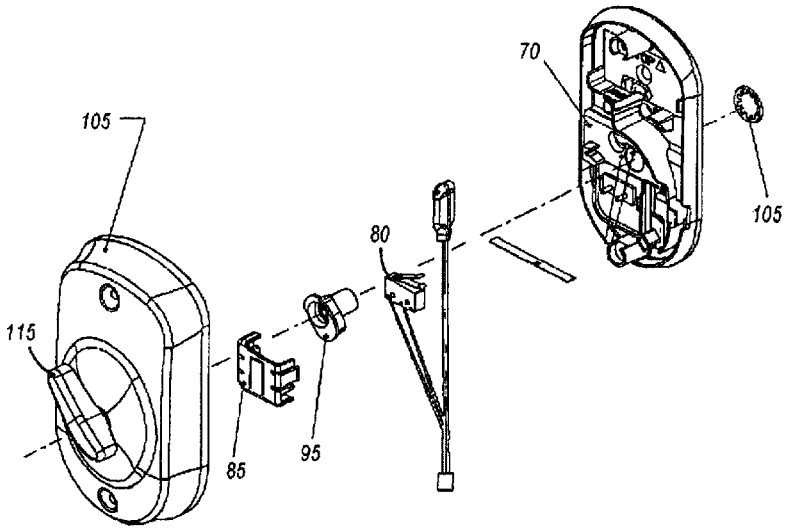
FIG. 2 is an exploded perspective view of an inside escutcheon assembly of the lock assembly of FIG. 1B.

FIG. 1A shows a lock assembly 10 that includes a conventional deadbolt assembly 15 mounted in a door 20 in the usual manner. The deadbolt assembly 15 includes a deadbolt 25 that is extendable and retractable through an opening in a face plate 30. The deadbolt assembly 15 also includes a frame 35 that has an opening 40. A linkage 45 is disposed inside the frame 35, and is operably connected to the deadbolt 25. Movement of the linkage 45 is controlled by a driver bar 50 that extends through the opening 40 such that pivotal movement or rotation of the driver bar 50 about a longitudinal axis 55 (FIG. 3) in one direction extends the deadbolt 25 and movement of the driver bar 50 in the other direction retracts the deadbolt 25. One of ordinary skill in the art will recognize that the foregoing arrangement is well known, and that any other type of deadbolt assembly that is operable by a driver bar as described above can be used.

Figure 3:
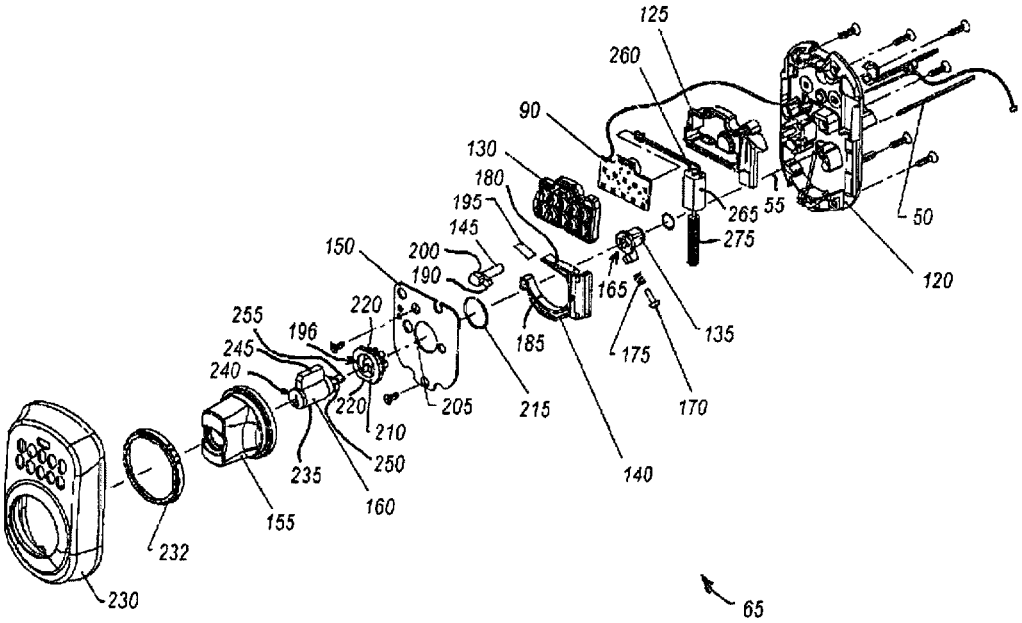
FIG. 3 is an exploded perspective view of an outside escutcheon assembly of the lock assembly of FIG. 1C.

FIGS. 1B, 1C, 2, and 3 show that the lock assembly 10 also includes an inside escutcheon assembly 60 and an outside escutcheon assembly 65. The inside escutcheon assembly 60 includes a base plate 70 that is attached to an inside wall of the door 20 over a hole 75 through the door 20. A switch 80 is coupled on the base plate 70, and a cover 85 is attached to the base plate 70 over the switch 80. The switch 80 is in communication with a printed circuit board or controller 90 (FIG. 3). A battery (not shown) is attached to the base plate 70 and is in electrical communication with the controller 90 to provide power to the controller 90.

The inside escutcheon assembly 60 also includes a cam 95 and an inside escutcheon 100. The cam 95 extends through an opening in the base plate 70 and is retained by a retaining ring 105. The cam 95 is pivotally movable between a lock-open position in which the cam 95 closes the switch 80 and a lock-closed position in which the cam 95 allows the switch 80 to be open. The cam 95 is coupled to the driver bar 50 so that the cam 95 is in the lock-open position when the deadbolt 25 is retracted, and so that the cam 95 is in the lock-closed position when the deadbolt 25 is extended.

The inside escutcheon 100 is coupled to the base plate 70 by screws 110 in the usual manner. A conventional thumbturn or turnpiece 115 is rotatably attached to the escutcheon 105, and is operably coupled to the driver bar 50, as is known in the art.

FIGS. 1C and 3 show that the outside escutcheon assembly 65 includes a base plate 120, a holder 125, and a keypad 130. The outside base plate 120 is attached to the outside of the door 20 over the hole 75, and is attached to the inside base plate 70 by screws 135, which attaches both base plates 70, 120 to the door 20, as is known in the art. The controller 90 is coupled to the holder 125, which is fixed to the base plate 120. The keypad 130 is coupled to the holder 125 and is in communication with the controller 90 to deliver one or more inputs to the controller 90.

FIG. 3 shows that the outside escutcheon assembly 65 also includes a cam clutch 135, a retaining wall 140, a manual release cam 145, a retaining plate 150, an outer thumbturn or turnpiece 155, and a cylinder lock 160. The cam clutch 135 is coupled to the base plate 120, and is pivotable about the longitudinal axis 55. An outer end of the manual release cam 145 (i.e., the left end of the manual release cam 145 in FIG. 3) has perpendicular slots 165 that form a cross shape. An inner end of the manual release cam 145 is drivingly coupled to the driver bar 50 so that the driver bar 50 and the manual release cam 145 pivot together about the axis 55 with the inside manual release cam 145 and with the inside turnpiece 115. A pin 170 is movably supported by the manual release cam 145 for movement along a line that is generally perpendicular to the axis 55 and that is between inner and outer or engaged and disengaged positions. The pin 170 is biased toward the disengaged position by a spring 175. An outer end of the pin 170 is rounded to form a manual release camming surface.

The retaining wall 140 is movably mounted on the base plate 120 below the holder 125. The retaining wall 140 includes an upper extension that extends above the manual release cam 145, and a lower extension that is disposed below the manual release cam 145. The upper extension has a generally horizontal upper surface 180. The lower extension has an upwardly facing, arcuate cam surface 185 that defines a portion of a circle. The cam surface 185 engages the outer end of the pin 170. When the retaining wall 140 is in an upper position, the cam surface 185 is centered on the axis 55. As the retaining wall 140 moves to its upper position, the cam surface 185 moves the pin 170 to the engaged position. The circular configuration of the surface allows the manual release cam 145 and the pin 170 to pivot about the axis 55 while the pin 170 engages the cam surface 185, and further allows the cam surface 185 to engage the pin 170 regardless of the location of the pin 170.

The manual release cam 145 is pivotally coupled to the base plate 120 above the retaining wall 140, and extends through an opening in the base plate 120 and through an opening in the inside base plate 70. The manual release cam 145 is further pivotal between an engaged position and a disengaged position. An inner end of the manual release cam 145 (the right end of the manual release cam 145 in FIG. 3) is accessible by removing the inside escutcheon 100, and includes a slot that is engageable by a screwdriver or other similar tool.

The manual release cam 145 also includes a release cam surface 190 that is engageable with the upper surface 180. The manual release cam 145 is normally held in the engaged position by a spring plate 195 that is mounted on the base plate 120 and that engages a generally D-shaped upper surface 200 of the manual release cam 145. The D-shaped surface 200 and the spring plate 195 cooperate to form an over-center mechanism that holds the manual release cam 145 in position, which is normally the engaged position. The force of the spring plate 195 must be overcome to pivot the manual release cam 145 to a different position.

When the retaining wall 140 is in the upper position, the upper surface 180 abuts or is closely spaced from the release cam surface 190 when the manual release cam 145 is in its engaged position. From this state, pivotal movement of the manual release cam 145 to the disengaged position causes the release cam surface 190 to push generally downward on the upper surface 180 of the wall and to move the retaining wall 140 to the lower position. Such movement of the retaining wall 140 and the release cam surface 190 allows the pin 170 to return to the disengaged position under the force of the spring 175.

The retaining plate 150 is coupled to the base plate 120 over the retaining wall 140, and has a circular opening 205 that is centered on the axis 55. An adapter 210 is coupled to the retaining plate 150 within the circular opening 205 for pivotal movement relative to the base plate 120 about the axis 55. A retaining ring 215 holds the adapter 210 in the circular opening 205. An inner end (the right end in FIG. 3) of the adapter 210 is generally cylindrical and has a plurality of axially extending notches that are spaced around the inner end. When the pin 170 on the cam clutch 135 is in the inner or engaged position, the pin 170 extends into one of the notches so that the cam clutch 135 and the adapter 210 pivot together, which in turn causes pivotal movement of the cam clutch 135, the driver bar, and the inside turnpiece 115. An outer end of the adapter 210 includes two opposed flat portions 220 and a rectangular slot 225 that is centered on the axis 55.

The outside escutcheon assembly 65 includes an outside escutcheon 230 that is coupled to the base plate 120 over the turnpiece 155. The outside turnpiece 155 is coupled to the adapter 210 and to the outside escutcheon 230, and includes flat portions that engage the flat portions 220 of the adapter 210. A washer 232 is located between the turnpiece 155 and the outside escutcheon 230. An inner end of the turnpiece 155 receives the outer end of the adapter 210 so that the adapter 210 and the turnpiece 155 pivot together. As shown in FIG. 1A, the slot 225 in the adapter 210 extends vertically when the turnpiece 155 is in a vertical orientation.

With continued reference to FIG. 3, the cylinder lock 160 includes a housing 235 that is supported within the turnpiece 155, and a plug 240 that is disposed in the housing 235 and that is movable between a locked position and an unlocked position. The housing 235 includes a pin portion 245 that extends into a recess of the turnpiece 155 to limit axial movement of the housing 235 relative to the turnpiece 155 and to permit movement of the housing 235 in response to movement of the turnpiece 155. In other words, pivotal movement of the housing 235 relative to the turnpiece 155 is substantially inhibited by engagement of the pin portion 245 with the turnpiece 155.

The plug 240 is rotatable between the locked position and the unlocked position relative to the housing 235 with a key inserted into a key slot, as is known in the art. The plug 240 includes a generally rectangular blocking portion 250 and a driver tab 255 that extend axially from and that rotate in response to rotation of the plug 240. The blocking portion 250 extends substantially along the axis 55 when the plug 240 is in the locked position, which inhibits extension of the blocking portion 250 into the slot 225 in the adapter 210, and which substantially blocks axial movement of the housing 235 relative to the turnpiece 155. The driver tab 255 is generally rectangular in cross-section, and extends from the blocking portion 250 along the axis 55.

When an appropriate key is not positioned in the plug 240 and the turnpiece 155 is in the vertical position, the driver tab 255 extends substantially horizontally when viewed from an end of the cylinder lock 160 and along the axis 55 in FIG. 3. When an appropriate key is inserted into the plug 240 and is rotated, the blocking portion 250 and the driver tab 255 rotate with the plug 240 such that the blocking portion 250 extends substantially vertically and is aligned with the slot 225 in the adapter 210. The appropriate key can then be pushed in, which moves the housing 235 inward relative to the turnpiece 155 (i.e., from left to right as viewed in FIG. 3), and moves the driver tab 255 axially into the aligned slot 165 in the cam clutch 135.

The driver tab 255 can extend into either one of the slots 165 in cam clutch 135, depending on the position of the manual release cam 145. The position of the manual release cam 145 is dependent on the position of the deadbolt 25 (i.e., extended or retracted). Rotation of the turnpiece 155 with an appropriate key inserted into the plug 240 causes rotation of the adapter 210, the driver tab 255, and the cam clutch 135, which in turn rotates the driver bar 50. The key can only be removed by pulling the housing 235 outward (i.e., from right to left as viewed in FIG. 3), which removes the driver tab 255 from the cam clutch 135 and disconnects the turnpiece 155 from the driver bar 50.

Figure 4:
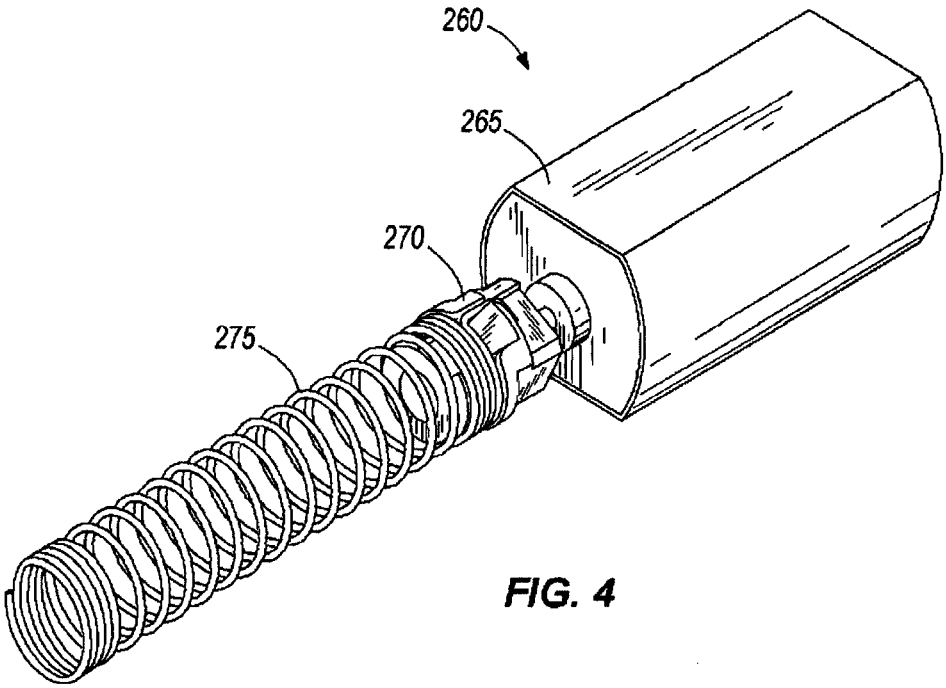
FIG. 4 is a perspective view of a motor drive mechanism of the outside escutcheon assembly of FIG. 3.
Figure 5:
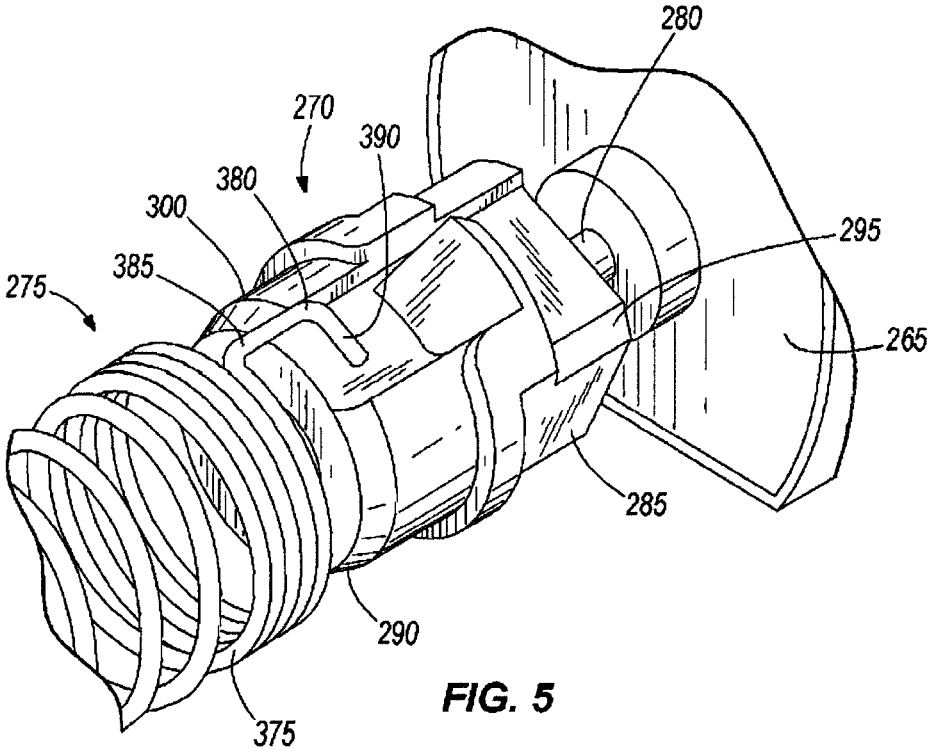
FIG. 5 is a perspective view of the motor drive mechanism being assembled.
Figure 6:
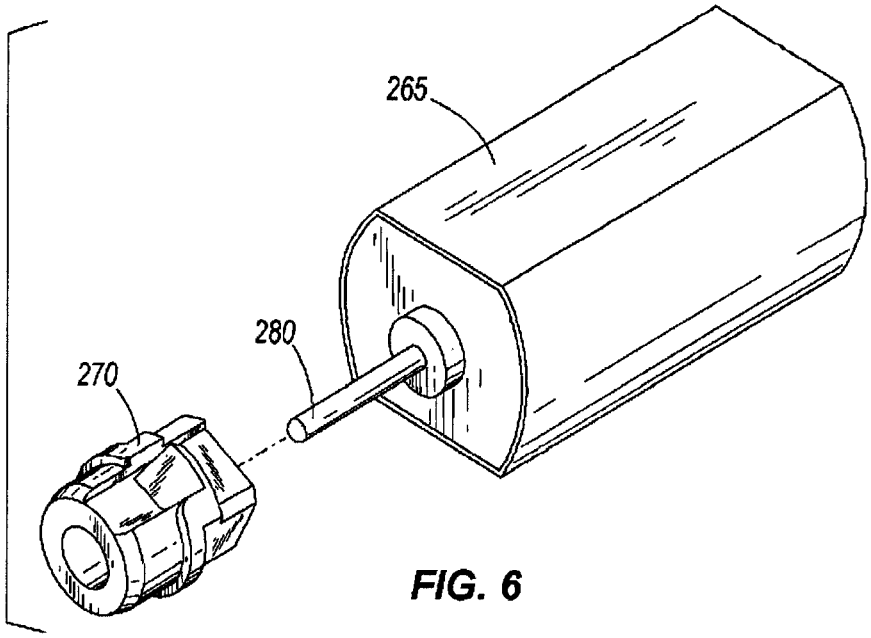
FIG. 6 is an exploded perspective view of a motor and a coupler of the motor drive mechanism of FIG. 5.

FIG. 3 shows that the lock assembly 10 also includes a motor assembly or motor drive mechanism 260 that is coupled to the base plate 120 and that is in communication with the controller 90 so that the controller 90 can control operation of the motor drive mechanism 260. FIGS. 3-5 show that the motor drive mechanism 260 includes an electric motor 265, a coupler 270, and a coil spring 275. The motor 265 is retained in position within the outside escutcheon assembly 65 by the holder 125. As shown in FIG. 6, the motor 265 includes a rotatable output shaft 280 that extends outward from the motor 265 (e.g., downward in FIG. 3). The shaft 280 is further is in communication with the coil spring 275 via the coupler 270 to translate rotational movement into substantially linear movement.

FIGS. 4-6 show that the coupler 270 is attached to the shaft 280 for rotation with the shaft 280. Generally, the coupler 270 can be formed from any material (e.g., plastic, metal, etc.) using any suitable process (e.g., molding, casting, etc.). The coupler 270 includes a body that has a first end 285 and a second end 290, and that defines a shaft opening (not shown) extending inward along an axial center of the body from adjacent the first end 285, and receiving the shaft 280 when the coupler 270 is attached to the motor 265. In some constructions, the shaft opening can define a press fit or interference fit attachment between the coupler 270 and the shaft 280. In other constructions, the coupler 270 can be attached to the shaft 280 by directly molding the coupler 270 onto the shaft 280. Generally, the coupler 270 can be attached to the shaft 280 in any suitable manner that limits the axial forces on the shaft during assembly of the coupler 270 and the motor 265, and that inhibits damage to the motor 265 when the coupler 270 is attached to the shaft 280.

Figure 7:
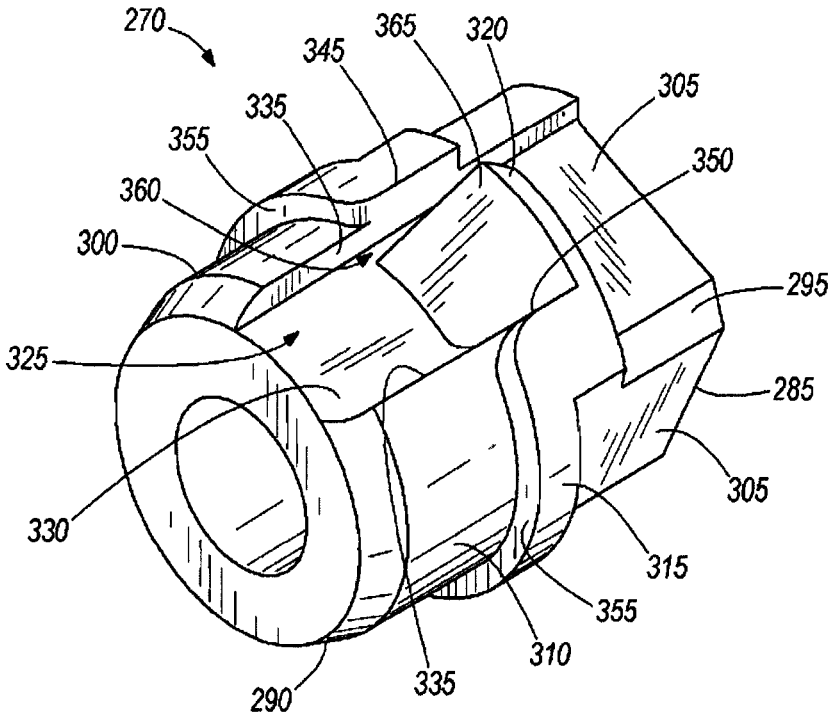
FIG. 7 is a perspective view of the coupler of FIG. 6.
Figure 8:
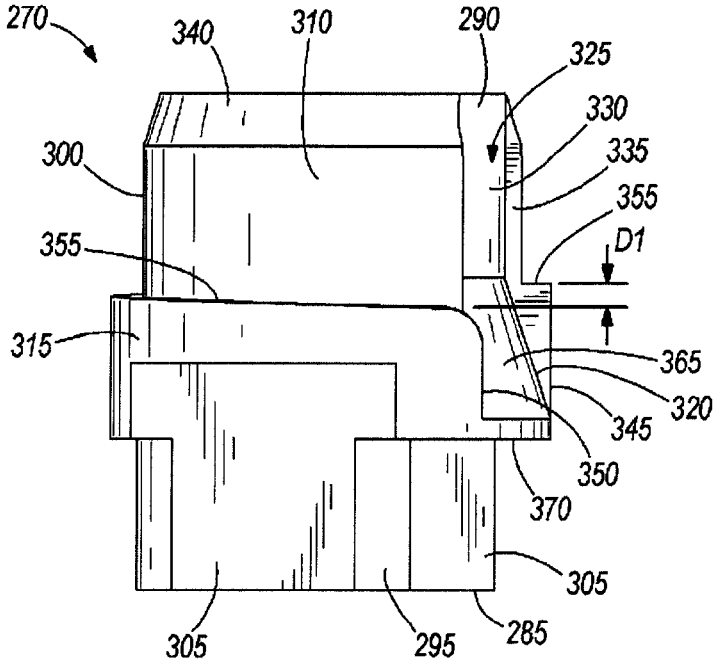
FIG. 8 is an end view of the coupler of FIG. 6.

FIGS. 5, 7, and 8 show that the coupler 270 is defined by a generally cylindrical shape, and includes an attachment portion 295 that is adjacent the first end 285 and a spring receiving portion 300 that is adjacent the second end 290. The attachment portion 295 includes two engagement surfaces 305 that are generally perpendicular to each other, and that are engageable to limit rotation of the coupler 270 during assembly of the motor drive mechanism 260. In the illustrated construction, the surfaces 305 are generally flat and perpendicular to each other. In some constructions, the coupler 270 can include more or fewer than two engagement surfaces 305. In other constructions, the coupler 270 may be held in place during assembly without any engagement surfaces 305.

The spring receiving portion 300 extends from the attachment portion 295 away from the motor 265, and includes a first cylindrical portion 310, a second cylindrical portion 315, and a ramp portion 320. The first cylindrical portion 310 includes an outer cylindrical surface that has an engagement recess 325. The engagement recess 325 extends toward the ramp portion 320 from adjacent the second end 290, and is defined by a lower surface 330 and opposed side walls 335. The lower surface 330 is in communication with the ramp portion 320 and defines a smooth transition between the lower surface 330 and the ramp portion 320. In the illustrated construction, the first cylindrical portion 310 also includes a tapered edge 340 adjacent the second end 290. In other constructions, the first cylindrical portion 310 may be without the tapered edge 340.

The second cylindrical portion 315 is disposed circumferentially along a perimeter of the body between the attachment portion 295 and the spring receiving portion 300. The second cylindrical portion 315 includes an outer cylindrical surface that is disposed radially outward from the outer cylindrical surface of the first cylindrical portion 310, and extends substantially around the perimeter of the body. The second cylindrical portion 315 also includes a first radial end 345 that is in communication with one side wall 335 of the engagement recess 325, and a second radial end 350 that is in communication with the other side wall 335 of the engagement recess 325.

A helical wall 355 is disposed between the first cylindrical surface of the first cylindrical portion 310 and the second cylindrical surface of the second cylindrical portion 315. As shown in FIG. 8, the helical wall 355 extends around the perimeter of the body between the first radial end 345 and the second radial end 350 from adjacent the second end 290 of the body toward the first end 285 of the body such that the portion of the helical wall 355 adjacent the first radial end 345 and the portion of the helical wall 355 adjacent the second end 290 define a non-zero distance D1. In other words, the helical wall 355 extends generally around the body from adjacent the spring receiving portion 300 toward the attachment portion 295 such that the portion of the helical wall 355 that is adjacent the second radial end 350 is closer to the first end 285 than the portion of the helical wall 355 that is adjacent the first radial end 345.

The ramp portion 320 is in communication with the first cylindrical portion 310 and the second cylindrical portion 315 to attach the coil spring 275 to the coupler 270. The ramp portion 320 is disposed between the first radial end 345 and the second radial end 350, and is further spaced apart from the first radial end 345 to define a channel 360. The ramp portion 320 extends radially outward from the first cylindrical portion 310 to the second cylindrical portion 315, and includes a lower end that is in communication with the lower surface 330. An upper end of the ramp portion 320 is radially spaced outward from the lower end. In other words, the ramp portion extends radially outward from the first end 285 to the second end 290. A transition surface 365 is defined between the lower end and the upper end. The lower end of the ramp portion 320 defines a substantially smooth transition between the lower surface 330 and the transition surface 365. As shown in FIG. 8, the upper end of the ramp portion is partially defined by a spring engagement surface 370 that is in communication with the attachment portion 295, and that extends substantially inward toward a center of the coupler 270. The engagement surface is further in communication with and substantially perpendicular to one of the surfaces 305.

Figure 9:
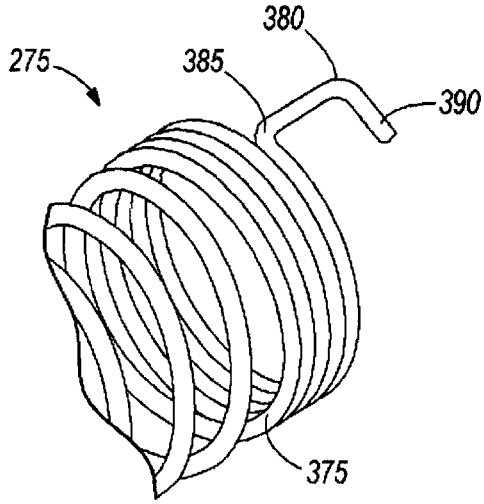
FIG. 9 is a partial perspective view of a spring of the motor drive mechanism of FIG. 5.

FIGS. 5 and 9 show that the coil spring 275 includes a coil portion 375 that defines a spring rate, and a hook or attachment 380 disposed on an end of the coil portion 375. The coil portion 375 includes a plurality of coils, and the end of the coil portion 375 that is adjacent the hook 380 is defined by a generally helical shape between the last coil and the second-to-last coil. The helical shape of the end of the coil portion 375 substantially conforms to the helical shape of the helical wall 355 so that the coil portion 375 is substantially engaged with the coupler 270 when the motor drive mechanism 260 is assembled.

FIG. 4 shows that the hook 380 is attached to the coupler 270 adjacent the ramp portion 320. The hook 380 includes a first leg member 385 that extends from the coil portion 375, and a second leg member 390 that is coupled to the first leg member 385, and that is oriented substantially perpendicular to the first leg member 385. The first leg member 385 extends through the channel 360 between the first radial end 345 and the ramp portion 320 when the coil spring 275 is attached to the coupler 270. The second leg member 390 is engaged with the spring engagement surface 370 and is biased toward a centerline of the coil spring 275 to retain the coil spring 275 on the coupler 270. In this manner, the coil spring 275 is attachable to and retained on the coupler 270 without the use of an adhesive (e.g., epoxy, etc.) or welding.

The retaining wall 140 is operably coupled to the coil spring 275 such that the retaining wall 140 is movable by the motor drive mechanism 260 between the engaged and disengaged positions. More particularly, the retaining wall 140 is coupled to the coil spring 275 such that rotation of the coil spring 275 causes vertical movement of the retaining wall 140 in either direction depending on the direction of rotation of the coil spring 275. The coil spring 275 is coupled to a pin (not shown) of the retaining wall 140 and acts on the pin in a screw-like manner to move the pin, and therefore the retaining wall 140, up or down (as viewed in FIG. 3) depending on the direction of rotation of the coil spring 275.

The motor drive mechanism 260 is used to transfer rotation of the shaft 280 generated by the motor 265 into linear movement of the retaining wall 140, which in turn activates the cam clutch 135. The motor drive mechanism 260 is assembled by attaching the coupler 270 to the motor 265, and by attaching the coil spring 275 to the coupler 270. FIG. 4 shows the motor drive mechanism 260 fully assembled. FIG. 6 shows the coupler prior to attachment or assembly onto the shaft 280. FIG. 5 shows the coupler 270 attached or assembled onto the shaft 280, and the coil spring 275 being attached or assembled onto the coupler 270.

Generally, the coupler 270 is attached to the shaft 280 without the use of external attachment methods (e.g., welding, etc.). As described above, the coupler 270 can be attached to the motor 265 by inserting the shaft 280 into the opening such that the opening defines a press fit between the shaft 280 and the coupler 270. In other constructions, the coupler 270 can be molded directly onto the shaft 280 to provide a rigid, rotatable attachment of the coupler 270 to the motor 265. The surfaces 305 of the attachment portion 295 allow the coupler 270 to be held in place during the assembly process so that the coupler 270 does not inadvertently rotate during attachment to the shaft 280, and so that damage to the motor 265 is substantially inhibited.

The coupler 270 and the coil spring 275 are mated to each other without external attachment methods (e.g., using an adhesive, welding, etc.). The coil spring 275 is attached to the coupler 270 by stabilizing the coupler 270 using the attachment portion 295, by aligning the hook 380 with the engagement recess 325, and by inserting the hook 380 into the engagement recess 325. Generally, the coil spring 275 is attached to the coupler 270 by moving the coil spring 275 and/or the coupler 270 linearly relative to each other and generally parallel to the axis 55, and sliding an end of the coil spring 275 onto the coupler 270 to retain the coil spring 275 on the coupler 270.

As the coil spring 275 is moved toward the coupler 270, the hook 380 slides along the lower surface 330 into engagement with the ramp portion 320. Engagement of the ramp portion 320 by the hook 380 causes the second leg member 390 to flex or bias generally away from the centerline of the coil spring 275. The hook 380 is trapped between the side walls 335 and between the first radial end 345 and the second radial end 350 as the hook 380 slides along the engagement recess 325 and up the ramp portion 320 to inhibit rotation of the coil spring 275 during the assembly process. The first leg member 385 is disposed over and partially within the channel 360 when the second leg member 390 is engaged with and moved along the transition surface 365.

When the hook 380 passes over a top of the ramp portion 320, the helical wall 355 engages the helically shaped coil portion 375, the first leg member 385 is substantially engaged with the coupler 270 within the channel 360, and the second leg member 390 snaps into engagement with the engagement surface. Engagement of the helically shaped coil portion 375 with the helical wall 355 substantially aligns the centerline of the coil spring 275 with the axis 55 so that rotation of the coupler 270 and the coil spring 275 caused by the motor 265 is substantially uniform. Engagement of the hook 380 with the ramp portion 320 securely attaches the coil spring 275 to the coupler 270, and limits axial movement of the coil spring 275 relative to the coupler 270. Attachment of the coil spring 275 to the coupler 270 in this manner further inhibits substantial rotation of the coil spring 275 relative to the coupler 270.

When the deadbolt 25 is extended (i.e., to lock the door 20), an operator on the outside of the door 20 can retract the deadbolt 25 (i.e., to unlock the door 20) either with the keypad 130 or with the key. An operator may use the key if the operator has forgotten the code to be entered on the keypad 130, if the keypad 130 is not working (e.g., when the battery has lost power), or simply by choice of the operator.

To use the key, the operator inserts the key in the lock 160, turns the key clockwise and pushes the key inward. As described above, this causes the driver tab 255 to enter one of the slots 165 in the cam clutch 135 and links the cam clutch 135 to the adapter 210. The operator can then turn the turnpiece 155, which pivots the driver bar 50 counterclockwise and retracts the deadbolt 25 in the conventional manner.

In the event the operator is using the key, it is possible that the driver tab 255 will not be aligned with one of the slots 165 in the cam clutch 135 when the operator initially tries to push the key in. In these circumstances, the driver tab 255 will bump into the end of the manual release cam 145, and the operator will not be able to push the key in. Further turning of the key a slight amount, which also turns the turnpiece 155, brings the driver tab 255 into alignment with the slots 165. The operator can then push the key in and couple the turnpiece 155 to the driver bar 50.

To use the keypad 130, the operator enters the programmed code on the keypad 130. The controller 90 receives the input and sends a signal to the motor drive mechanism 260, which moves the retaining wall 140 in a generally upward direction. Movement of the retaining wall 140 in the upward direction moves the pin 170 into the aligned notch, which links the cam clutch 135 to the adapter 210. The operator can then turn the turnpiece 155, which pivots the driver bar 50 counterclockwise and retracts the deadbolt 25. The movement of the driver bar 50 also causes the cam clutch 135 to close the switch, which sends a signal to the controller 90. The controller 90 then initiates a "relock" time delay, which gives the operator a predetermined amount of time to relock the deadbolt from the outside. After the relock time delay, the controller 90 sends a signal to the motor drive mechanism 260 to lower the retaining wall 140, which disconnects the outside turnpiece 155 from the driver bar 50.

The outside turnpiece 155 could conceivably be in any rotational orientation when an operator tries to turn it, either to lock or unlock the door 20. The notches in the adapter 210 allow for multiple orientations of the turnpiece 155 in the event the operator is using the keypad 130. When the operator uses the keypad 130 to engage the turnpiece 155, the motor drive mechanism 260 attempts to raise the retaining wall 140 to move the pin 170 into a notch that is aligned with the pin 170. If a notch is aligned with the pin 170, the pin 170 moves into the notch and couples the adapter 210 to the cam clutch 135. With the adapter 210 coupled to the cam clutch 135, the turnpiece 155 can be operated as described above.

If a notch is not aligned with the pin 170, the pin 170 engages a portion of the adapter 210 between two notches, which inhibits further inward movement of the pin 170 and further upward movement of the retaining wall 140. As the motor drive mechanism 260 continues to rotate the coil spring 275 in an attempt to raise the retaining wall 140, the coil spring 275 will extend or stretch when upward movement of the retaining wall 140 stops. Thereafter, when the operator starts to turn the turnpiece 155, the pin of the retaining wall 140 quickly becomes aligned with an adjacent notch, and the coil spring 275 will then return to its normal length and will pull the retaining wall 140 upward. By pulling the retaining wall 140 upward, the pin of the retaining wall 140 moves into the now-aligned notch, and the turnpiece 155 is engaged.

The operator can relock the door 20 either from the outside, as mentioned above, or from the inside after entering through the door 20. From the inside, the operator can turn the turnpiece 115 to lock the door 20. Relocking the door 20 from either side pivots the cam clutch 135 to open the switch 80, which sends another signal to the controller 90. The controller 90 may either ignore the signal from the switch 80 or use the signal to truncate the relock time delay. If the controller 90 ignores the signal, the controller 90 waits for the relock time to pass and then sends a signal to the motor drive mechanism 260 to lower the retaining wall 140, which disengages the cam clutch 135. As a result, the outside turnpiece 155 is no longer coupled to the driver bar 50.

If the controller 90 uses the signal to truncate the relock time delay, the controller 90 receives the signal indicative of the switch 80 being opened because the door 20 has been locked. The controller 90 immediately sends a signal to the motor drive mechanism 260 to lower the retaining wall 140, which disengages the cam clutch 135. As a result, the outside turnpiece 155 is no longer coupled to the driver bar 50. Thus, the relock time delay is truncated when the opens due to relocking of the deadbolt 25.

If the operator entered with the key because the electronics were not working, there would be no need to disengage the outside turnpiece 155 if the turnpiece 155 was not connected to the driver bar 50 in the first place. If the electronics fail after connecting the outside turnpiece 155 to the driver bar 50, the controller 90 cannot disengage the outside turnpiece 155 after entry. The manual release cam 145 allows the operator to manually disengage the outside turnpiece 155 in the unlikely event of such electronic failure. As described above, the operator can remove the inside escutcheon 100 and use a screwdriver to pivot the manual release cam 145 and lower the retaining wall 140, which disengages the outside turnpiece 155.

To unlock the deadbolt from the inside, the operator turns the turnpiece 115 clockwise. By turning the turnpiece 115 clockwise, the deadbolt 25 is retracted because the turnpiece 155 is engaged with the driver bar 50. Turning the turnpiece 155 in this manner also closes the switch 80, as described above, which sends a signal to the controller 90 to raise the retaining wall 140, which in turn engages the outside turnpiece 155 and initiates the relock time delay. The door 20 can be relocked by the operator until expiration of the relock time delay. After expiration of the relock time delay, the outside turnpiece 155 is disengaged. If the door 20 has already been relocked, it can no longer be opened from the outside without entering the code or using the key. If the door 20 has not been relocked, it can no longer be locked from the outside without entering the code or using the key. If the controller 90 is set to truncate the relock time delay, the outside turnpiece 155 is disengaged immediately after the door 20 is relocked.

In another mode of operation, the outside turnpiece 155 remains coupled to the driver bar 50 indefinitely (i.e., the clutch mechanism stays in the engaged configuration) until the operator extends the deadbolt 25 to secure the door 20. In other words, the relock time delay is indefinite. When the door 20 is relocked, the controller 90 disengages the outside turnpiece 155.

In yet another mode of operation, when the operator retracts the deadbolt 25 from the inside, the controller 90 receives the signal from the switch 80. However, the controller 90 does not operate the motor drive mechanism 260 to engage the outside turnpiece 155 until the controller 90 receives a second signal that is generated by pushing a designated key or other similar device on the outside keypad 130. Until the designated key is pushed, the outside turnpiece 155 remains disconnected from the driver bar 50 and the deadbolt remains in the retracted position, which leaves the door 20 in an unsecured/unlocked state. After the operator pushes the designated key, the controller 90 operates the motor drive mechanism 260 to connect the outside turnpiece 155 with the driver bar 50. The operator may then throw or extend the deadbolt 25 to secure the door 20 to the doorframe. Extending the deadbolt 25 opens the switch 80, which causes the controller 90 to operate the motor drive mechanism 260 to disconnect the outside turnpiece 155 from the driver bar 50, thus locking the door 20. It should be apparent to one of ordinary skill in the art that the states of the switch 80 could be reversed such that the switch 80 is closed when the deadbolt 25 is locked, and is open when the deadbolt 25 is unlocked.

Various features and advantages of the invention are set forth in the following claims.

The invention claimed is:

1. An apparatus comprising:

a motor including a rotatable output shaft extending outward from the motor and defining a rotational axis;

a coupler coupled to the output shaft for rotation therewith, the coupler including a spring receiving portion having a recess extending linearly along the coupler and parallel to the rotational axis from a free end of the coupler; and a coil spring coupled to the coupler without external attachment means such that rotation of the coupler is transferred to the coil spring, the coil spring coupled to the coupler over the spring receiving portion and extending axially into the recess such that engagement of the coil spring with the recess from adjacent the free end limits rotation of the coil spring relative to the coupler during attachment of the coil spring to the coupler.

2. The apparatus of claim 1, wherein the coupler is press fit onto the output shaft.

3. The apparatus of claim 1, wherein the coupler is molded onto the output shaft.

4. The apparatus of claim 1, wherein the coupler further includes an attachment portion having at least one engagement surface engageable to limit rotation of the coupler during attachment of the coupler to the output shaft.

5. The apparatus of claim 1, wherein the spring receiving portion defines a helical wall, wherein the coil spring includes an attachment and a coil portion having a last coil and a second-to-last coil positioned proximate the attachment, and wherein the coil portion is defined by a generally helical shape between the last coil and the second-to-last coil that substantially conforms to the shape of the helical wall so that the coil spring is substantially aligned with the coupler along the rotational axis.

6. The apparatus of claim 5, wherein the helical wall extends around a perimeter of the coupler between a first radial end and a second radial end such that the portion of the helical wall adjacent the first radial end and the portion of the helical wall adjacent the second end define a non-zero distance.

7. The apparatus of claim 6, wherein the helical wall extends generally around the perimeter of the coupler away from the spring receiving portion.

8. The apparatus of claim 6, wherein the spring receiving portion further includes a ramp portion disposed between the first radial end and the second radial end and partially defined by a spring engagement surface extending inward toward a center of the coupler to attach the attachment to the coupler.

9. The apparatus of claim 8, wherein the ramp portion extends radially outward from the spring receiving portion and includes a transition surface engageable by the coil spring.

10. The apparatus of claim 8, wherein the coil spring includes an attachment having a first leg member and a second leg member coupled to the first leg member and engaged with the spring engagement surface such that the coil spring is retained in engagement with the coupler.

11. The apparatus of claim 10, wherein the ramp portion is spaced apart from the first radial end and defines a channel therebetween, and wherein the first leg member extends through the channel when the coil spring is attached to the coupler.

12. An apparatus comprising:

a motor including a rotatable output shaft extending outward from the motor and defining a rotational axis;

a coupler coupled to the output shaft for rotation therewith, the coupler including a spring receiving portion having a recess extending linearly along the coupler and parallel to the rotational axis from a free end of the coupler; and a coil spring coupled to the coupler over the spring receiving portion and extending axially into the recess such that engagement of the coil spring with the recess from adjacent the free end limits rotation of the coil spring relative to the coupler during attachment of the coil spring to the coupler.

13. The apparatus of claim 12, wherein the coil spring includes an attachment disposed on an end of the coil spring, and wherein the spring receiving portion further includes a ramp portion engageable by the attachment to attach the coil spring to the coupler without external attachment means.

14. The apparatus of claim 13, wherein the attachment includes a first leg member and a second leg member extending from and substantially perpendicular to the first leg member, and wherein the second leg member is slidable along the recess into engagement with the ramp portion.

15. The apparatus of claim 14, wherein the spring receiving portion further includes a first cylindrical portion and a second cylindrical portion, and wherein the ramp portion extends radially outward from the first cylindrical portion to the second cylindrical portion and is partially defined by a spring engagement surface engaged by the second leg member to attach the coil spring to the coupler.

16. The apparatus of claim 15, wherein the second cylindrical portion includes a first radial end and a second radial end, and wherein the ramp portion is spaced apart from the first radial end to define a channel engaged by the first leg member when the coil spring is attached to the coupler.

17. The apparatus of claim 12, wherein:

the coil spring includes a coil portion and a bent hook disposed on an end of the coil spring, the bent hook has a first leg member and a second leg member coupled and oriented perpendicular to the first leg member, the spring receiving portion further includes a ramp portion disposed at an inner axial end of the recess, the ramp portion extends outward from the coupler and is in communication with a surface defining the recess, the ramp portion defines a spring engagement surface extending radially inward from a top of the ramp portion, the spring engagement surface is oriented to face away from the free end of the coupler, the bent hook is axially slidable along the recess into engagement with the ramp portion and the second leg member is slidable along the ramp portion, the second leg member passes over the top of the ramp portion and is engaged with the spring engagement surface to retain the coil spring on the coupler, the coupler further defines an axial channel extending parallel to the axis and disposed on a lateral side of the ramp portion, and the first leg member is disposed at least partially within the channel when the first leg member is engaged with the spring engagement surface.

18. The apparatus of claim 17, wherein:

the spring receiving portion defines a helical wall, the coil portion has a last coil and a second-to-last coil positioned proximate the bent hook, and the coil portion is defined by a generally helical shape between the last coil and the second-to-last coil that conforms to the shape of the helical wall so that the coil spring is aligned with the coupler along the rotational axis.

19. An electronic lock assembly comprising:

a retractable and extendable deadbolt movable between a locked position and an unlocked position;

a housing including a base plate attachable to a door, an escutcheon, and a retaining wall positioned between the base plate and the escutcheon and movably mounted to the base plate;

a controller coupled to the base plate for controlling movement of the deadbolt between the locked position and the unlocked position;

a keypad coupled to the escutcheon and in communication with the controller to deliver one or more inputs to the controller; and a motor drive mechanism including a motor in communication with the controller for controlling operation of the motor drive mechanism, the motor having a rotatable output shaft extending outward from the motor and defining a rotational axis, a coupler coupled to the output shaft for rotation therewith, the coupler including a spring receiving portion having a recess extending linearly along the coupler and parallel to the rotational axis from a free end of the coupler, and a coil spring attached to the coupler without external attachment means, the coil spring in communication with the output shaft via the coupler such that rotational movement of the output shaft is transferred to the coil spring, the coil spring coupled to the coupler over the spring receiving portion and extending axially into the recess such that engagement of the coil spring with the recess from adjacent the free end limits rotation of the coil spring relative to the coupler during attachment of the coil spring to the coupler, the coil spring further in communication with the retaining wall such that the rotational movement of the coil spring is translated into substantially linear movement of the retaining wall.

20. The electronic lock assembly of claim 19, wherein the coupler includes an attachment portion having at least one engagement surface engageable to limit rotation of the coupler during attachment of the coupler to the output shaft.

21. The electronic lock assembly of claim 19, wherein the spring receiving portion defining a helical wall extending around a perimeter of the coupler between a first radial end and a second radial end such that the portion of the helical wall adjacent the first radial end and the portion of the helical wall adjacent the second end define a non-zero distance.

22. The electronic lock assembly of claim 21, wherein the coil spring includes a coil portion partially defined by a generally helical shape substantially conforming to the shape of the helical wall to align the coil spring with the coupler along the rotational axis.

23. The electronic lock assembly of claim 21, wherein the spring receiving portion further includes a ramp portion disposed between the first radial end and the second radial end to attach the coil spring to the coupler.

24. The electronic lock assembly of claim 23, wherein the ramp portion is partially defined by a spring engagement surface extending inward toward an axial center of the coupler, and wherein the coil spring includes an attachment slidable along the ramp portion and engaged with the spring engagement surface.

25. The electronic lock assembly of claim 24, wherein the ramp portion is spaced apart from the first radial end to define a channel, and wherein attachment includes a first leg member extending through the channel when the coil spring is attached to the coupler.

26. The electronic lock assembly of claim 24, wherein the attachment further includes a second leg member slidable along the recess into engagement with the ramp portion during attachment of the coil spring to the coupler such that rotation of the coil spring relative to the coupler is substantially limited.

27. The electronic lock assembly of claim 19, wherein the coupler is one of press fit onto the output shaft or molded onto the output shaft.

* * * * *